US010661937B2

(12) United States Patent
Godet

(10) Patent No.: US 10,661,937 B2
(45) **Date of Patent: *May 26, 2020**

(54) CONTAINER PROVIDED WITH A CURVED INVERTIBLE DIAPHRAGM

(71) Applicant: SIDEL PARTICIPATIONS, Octeville-sur-Mer (FR)

(72) Inventor: Florian Godet, Octeville-sur-Mer (FR)

(73) Assignee: SIDEL PARTICIPATIONS, Octeville-sur-Mer (FR)

( * ) Notice: Subject to any disclaimer, the term of this patent is extended or adjusted under 35 U.S.C. 154(b) by 111 days.

This patent is subject to a terminal disclaimer.

(21) Appl. No.: 15/739,265

(22) PCT Filed: Jun. 22, 2016

(86) PCT No.: PCT/EP2016/064413

§ 371 (c)(1),
(2) Date: Dec. 22, 2017

(87) PCT Pub. No.: WO2016/207213

PCT Pub. Date: Dec. 29, 2016

(65) Prior Publication Data

US 2018/0312291 A1 Nov. 1, 2018

(30) Foreign Application Priority Data

Jun. 23, 2015 (FR) ..... 15305969.6

(51) Int. Cl.
*B65D 1/02* (2006.01)
*B65D 79/00* (2006.01)
*B67C 3/22* (2006.01)

(52) U.S. Cl.
CPC ..... *B65D 1/0276* (2013.01); *B65D 79/005* (2013.01); *B67C 3/22* (2013.01); *B67C 2003/226* (2013.01)

(58) Field of Classification Search
CPC .. B65D 1/0276; B65D 1/0223; B65D 79/005; B65D 1/44; B65D 1/40; B65D 1/0261
(Continued)

(56) References Cited

U.S. PATENT DOCUMENTS 5,704,503 A 1/1998 Krishnakumar et al.
9,296,539 B2 * 3/2016 Wright ..... B65D 1/0276
(Continued)

FOREIGN PATENT DOCUMENTS

EP 0 784 569 A1 7/1997
EP 2821349 A1 1/2015
(Continued)

OTHER PUBLICATIONS

International Search Report, dated Sep. 12, 2016, from corresponding PCT application No. PCT/EP2016/06441.

*Primary Examiner* — Shawn M Braden

(57) ABSTRACT

Disclosed is a container made of a plastic material, provided with a base including a standing ring forming a support flange and a diaphragm extending from the standing ring to a central portion, the diaphragm being capable of standing in an outwardly-inclined position. The diaphragm connects to the standing ring at an outer junction forming an outer articulation of the diaphragm. The diaphragm connects to the central portion at an inner junction forming an inner articulation of the diaphragm. The diaphragm is invertible with respect to the standing ring from the outwardly-inclined position to an inwardly-inclined position. In the outwardly-inclined position, the diaphragm has an outer curved portion and an inner curved portion of opposite curvatures.

20 Claims, 4 Drawing Sheets

(58) Field of Classification Search
USPC ..... 215/371, 373
See application file for complete search history.

(56) References Cited

U.S. PATENT DOCUMENTS

| | | | | |
|---|---|---|---|---|
| 9,994,378 | B2 * | 6/2018 | Wurster | B65D 1/0276 |
| 10,053,276 | B2 * | 8/2018 | Godet | B65D 1/0207 |
| 10,059,482 | B2 * | 8/2018 | Mast | B65D 1/0276 |
| 2008/0047964 | A1 | 2/2008 | Denner et al. | |
| 2009/0159556 | A1 * | 6/2009 | Patcheak | B65D 1/0276<br>215/373 |
| 2015/0041426 | A1 * | 2/2015 | Oguchi | B65D 1/0223<br>215/382 |

FOREIGN PATENT DOCUMENTS

| | | | |
|---|---|---|---|
| WO | 96/13436 | A1 | 5/1996 |
| WO | 2006/068511 | A1 | 6/2006 |

* cited by examiner

CONTAINER PROVIDED WITH A CURVED INVERTIBLE DIAPHRAGM

FIELD OF THE INVENTION

The invention generally relates to the manufacturing of containers, such as bottles, which are produced by blow molding or stretch-blow molding from preforms made of plastic (mostly thermoplastic, e.g. PET) material. More specifically but not exclusively, the invention relates to the processing of hot-fill containers, i.e. containers filled with a hot pourable product (typically a liquid), the term "hot" meaning that the temperature of the product is greater than the glass transition temperature of the material in which the container is made. Typically, hot filling of PET containers (the glass transition temperature of which is of about 80° C.) is conducted with products at a temperature comprised between about 85° C. and about 100° C., typically at 90° C.

BACKGROUND OF THE INVENTION

Several types of containers are (at least allegedly) specifically manufactured to withstand the mechanical stresses involved by the hot filling and the subsequent changes of internal pressure due to the temperature drop.

It is known to provide the container sidewall with flexible pressure panels the curvature of which changes to compensate for the change of pressure inside the container, as disclosed in European Patent No. EP 0 784 569 (Continental PET). One main drawback of this type of container, however, is its lack of rigidity once opened. Indeed, the pressure panels tend to bend under the grabbing force of the user, who should hence handle the container with care to avoid unintentional splashes.

It is also known to provide the container with a rigid sidewall and a flexible base including an invertible pressure panel.

In a first technique, the pressure panel is flexible and self adjusts to the changes in pressure inside the container. U.S. Pat. No. 8,444,002 (Graham Packaging) discloses a container the base of which is provided with a pressure compensating panel having numerous hinges and panels, which progressively yield or yield simultaneously depending on the pressure difference between the inside of the container and the outside of the container. Although such a structure has proved efficient to adapt to the changes in pressure inside the container and to maintain the shape of the container sidewall when the container stands alone, it does not provide the necessary strength to withstand external stresses such as vertical compression stresses undergone by the container when stacked or palletized.

In a second technique, disclosed in U.S. Pat. Appl. No. 2008/0047964 (Denner et al, assigned to CO2PAC), in order to alleviate all or a portion of the vacuum forces within the container, the pressure panel is moved from an outwardly-inclined position to an inwardly-inclined position by a mechanical pusher after the container has been capped and cooled, in order to force the pressure panel into the inwardly-inclined position.

Tests conducted on such a container showed that, once inverted to the inwardly-inclined position, the pressure panel does not maintain its position but tends to sink back under the pressure of the content. In the end, after the content has cooled, the container has lost much rigidity and therefore feels soft when held in hand. When stacking or palletizing the containers, there is a risk for the lower containers to bend under the weight of upper containers, and hence a risk for the whole pallet to collapse.

SUMMARY OF THE INVENTION

It is an object of the invention to propose a container having greater stability.

It is another object of the invention to propose a container provided with an invertible diaphragm capable of maintaining an inverted position and hence of withstanding high external stresses such as axial compression stresses.

It is therefore provided a container made of a plastic material, provided with a base including a standing ring forming a support flange and a diaphragm extending from the standing ring to a central portion, said diaphragm being capable of standing in an outwardly-protruding position, said container defining an inner volume to be filled with a product, wherein the diaphragm connects to the standing ring at an outer junction forming an outer articulation of the diaphragm with respect to the standing ring;

wherein the diaphragm connects to the central portion at an inner junction forming an inner articulation of the diaphragm with respect to the central portion;

whereby said diaphragm is invertible with respect to the standing ring from the outwardly-protruding position, in which the inner junction extends below the outer junction, to an inwardly-protruding position in which the inner junction extends above the outer junction;

wherein, in the outwardly-protruding position, the diaphragm has:

- an outer portion which connects to the standing ring and is curved in radial section, said outer portion having a concavity turned outwards with respect to the inner volume of the container, and
- an inner portion which connects to the outer portion and to the central portion and is curved in radial section, said inner portion having a concavity turned inwards with respect to the inner volume of the container.

The outer portion facilitates inversion of the diaphragm, while its inner portion provides rigidity in the inverted position, which prevents the diaphragm from sinking back. Pressure within the container is thereby maintained to a high value, providing high rigidity to the container. The important volume swept by the diaphragm between the outwardly-protruding position and the inwardly-protruding position increases the pressure inside the container to such a level that the loss of pressure due to temperature drop does not affect the rigidity of the container, which may hence be trustingly stacked or palletized.

According to various embodiments, taken either separately or in combination:

- the radius, denoted R1, of the outer portion and the outer diameter, denoted D, of the diaphragm at the outer junction are such that:

$$\frac{D}{20} \leq R1 \leq \frac{D}{4}$$

- the radius, denoted R2, of the inner portion and the outer diameter, denoted D, of the diaphragm at the outer junction are such that:

$$\frac{D}{6} \leq R2 \leq \frac{D}{2}$$

the radius, denoted R1, of the outer portion and the radius, denoted R2, of the inner portion, are such that:

$$R1 \leq R2$$

the outer diameter, denoted D, of the diaphragm at the outer junction, and its inner diameter, denoted d, at the inner junction, are such that:

$$0.3 \cdot D \leq d \leq 0.6 \cdot D$$

$$d \cong 0.4 \cdot D$$

the diaphragm has a smooth surface;

a junction point between the outer portion and the inner portion is located above or on a line joining the outer junction and the inner junction.

The above and other objects and advantages of the invention will become apparent from the detailed description of preferred embodiments, considered in conjunction with the accompanying drawings.

DETAILED DESCRIPTION

Figure 1:
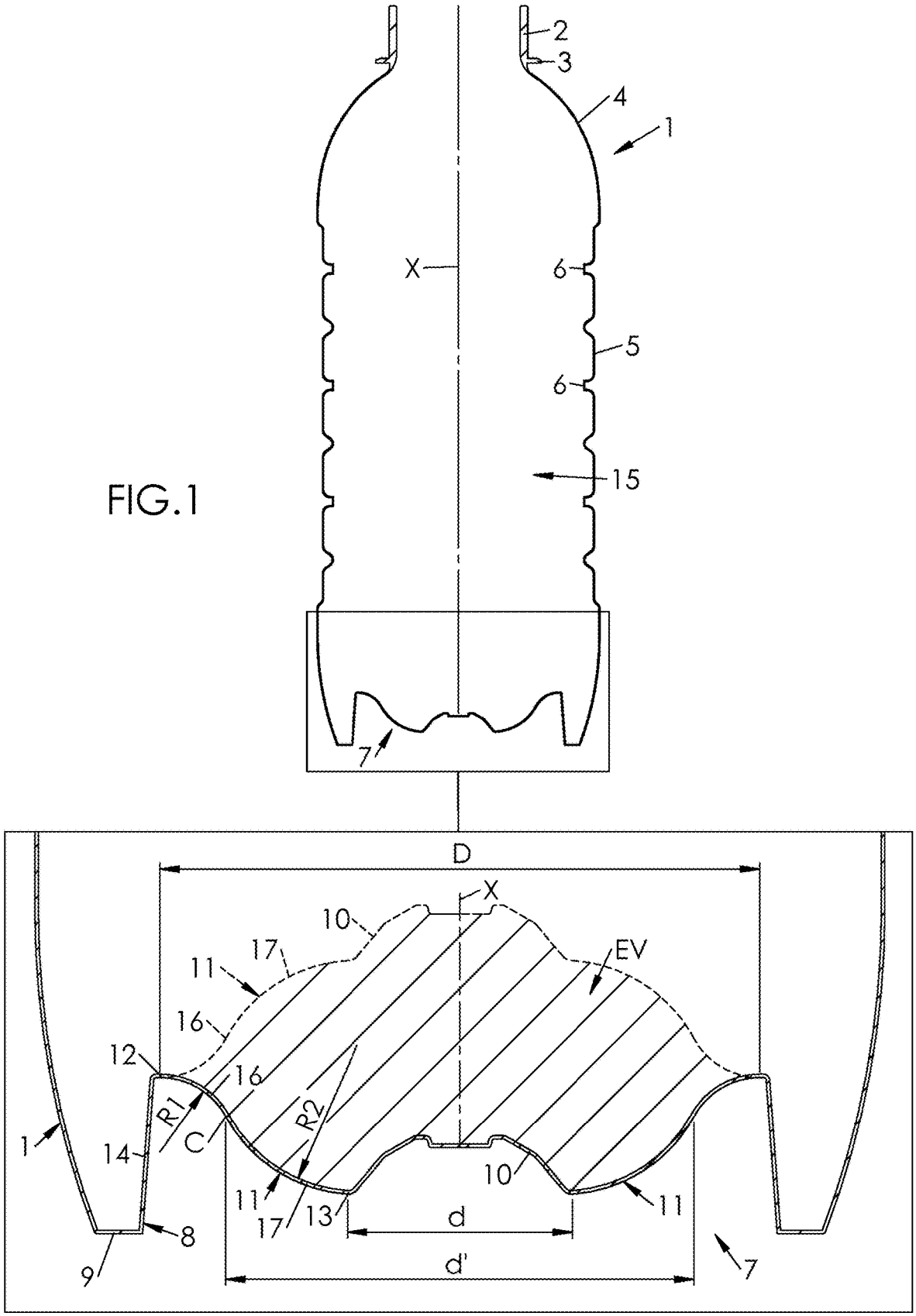
FIG. 1 is a sectional view showing a container provided with an invertible base diaphragm; this view includes a detail of the base at enlarged scale.

FIG. 1 shows a container 1 suitable for being filled with a hot product (such as tea, fruit juice, or a sports drink), "hot" meaning that the temperature of the product is greater than the glass transition temperature of the material in which the container 1 is made (about 80° C. in the case of PET).

The container 1 includes an upper open cylindrical threaded upper portion or neck 2, which terminates, at a lower end thereof, in a support collar 3 of greater diameter. Below the collar 3, the container 1 includes a shoulder 4 which is connected to the collar 3 through a cylindrical upper end portion of short length.

Below the shoulder 4, the container 1 has a sidewall 5 which is substantially cylindrical around a container main axis X. The sidewall 5 may, as depicted on FIG. 1, include annular stiffening ribs 6 capable of resisting stresses which would otherwise tend to make the sidewall 5 oval when viewed in a horizontal section (such a deformation is standard and called ovalization).

At a lower end of the sidewall 5, the container 1 has a base 7 which closes the container 1 and allows it to be put on a planar surface such as a table.

The container base 7 includes a standing ring 8 which forms a support flange 9 extending in a plane substantially perpendicular to the main axis X, a central portion 10 and a diaphragm 11 extending from the standing ring 8 to the central portion 10.

The diaphragm 11 connects to the standing ring 8 at an outer junction 12 and to the central portion 10 at an inner junction 13. Both the outer junction 12 and the inner junction 13 are preferably curved (or rounded).

The diaphragm 11 has an inner diameter d, measured on the inner junction 13, and an outer diameter D, measured on the outer junction 12.

The container 1 is blow-molded from a preform made of plastic such as PET (polyethylene terephtalate) including the unchanged neck, a cylindrical wall and a rounded bottom.

In a preferred embodiment depicted on the drawings, the standing ring 8 is a high standing ring, i.e. the standing ring is provided with a frustoconical inner wall 14, a top end of which forms the outer junction 12 (and hence the outer articulation with the diaphragm 11), whereby in the outwardly-protruding position of the diaphragm 11 the central portion 10 stands above the standing ring 8.

The container 1, which defines an inner volume 15 to be filled with a product, is blow-molded with the diaphragm 11 standing in an outwardly-protruding position in which the inner junction 13 is located below the outer junction 12 (the container 1 being held normally neck up).

The outer junction 12 forms an outer articulation of the diaphragm 11 with respect to the standing ring 8 (and more precisely with respect to the inner wall 14) and the inner junction 13 forms an inner articulation of the diaphragm 11 with respect to the central portion 10, whereby the diaphragm 11 is invertible with respect to the standing ring 8 from the outwardly-protruding position (in solid line on FIG. 1 and FIG. 4 to FIG. 11) to an inwardly-protruding position wherein the inner junction 13 is located above the outer junction 12 (in dotted lines on FIG. 1 and FIG. 4 to FIG. 11).

Inversion of the diaphragm 11 is preferably achieved mechanically (e.g. with a pusher mounted on a jack), after the container 1 has been filled with a product, capped and cooled down, in order to compensate for the vacuum generated by the cooling of the product or to increase its internal pressure, and to provide rigidity to the sidewall 5.

Inversion of the diaphragm 11 provokes a liquid displacement (and a subsequent decrease of the inner volume of the container 1) of a volume which is denoted EV (in hatch lines in the detail of FIG. 1) and called "extraction volume". The extraction volume EV is comprised between the outwardly-protruding position of the diaphragm 11 and its inwardly-protruding position.

In order to increase the rigidity of the diaphragm 11 and to increase the pressure of the content in the inwardly-protruding position, the diaphragm is provided with a curved outer portion 16 and a curved inner portion 17.

The outer portion 16 connects to an upper end of the inner wall 14 at the outer junction 12 and is curved in radial section. More specifically, when viewed in radial section in the outwardly-protruding position, the outer portion 16 has a concavity turned outwards with respect to the inner volume 15 of the container 1. R1 denotes the radius of the outer portion 16. As depicted on the drawings, at the outer junction 12, the tangent to the outer portion 16 is horizontal (i.e. perpendicular to the axis X).

The inner portion 17 connects to the outer portion 16 and to the central portion 10, and is curved in radial section. More specifically, when viewed in radial section in the outwardly-protruding position, the inner portion 17 has a concavity turned inwards with respect to the inner volume 15 of the container 1, whereby the diaphragm 11 has, in its outwardly-protruding position, a cyma recta (or S) shape. R2 denotes the radius of the inner portion 17. In a preferred embodiment depicted on the drawings, the inner portion 17 is tangent to the outer portion 16.

As illustrated on FIG. 1, diaphragm 11 is such shaped and dimensioned that, in its outwardly-protruding position, the inner junction 13 stands above the plane defined by the standing ring 8.

Figure 2:
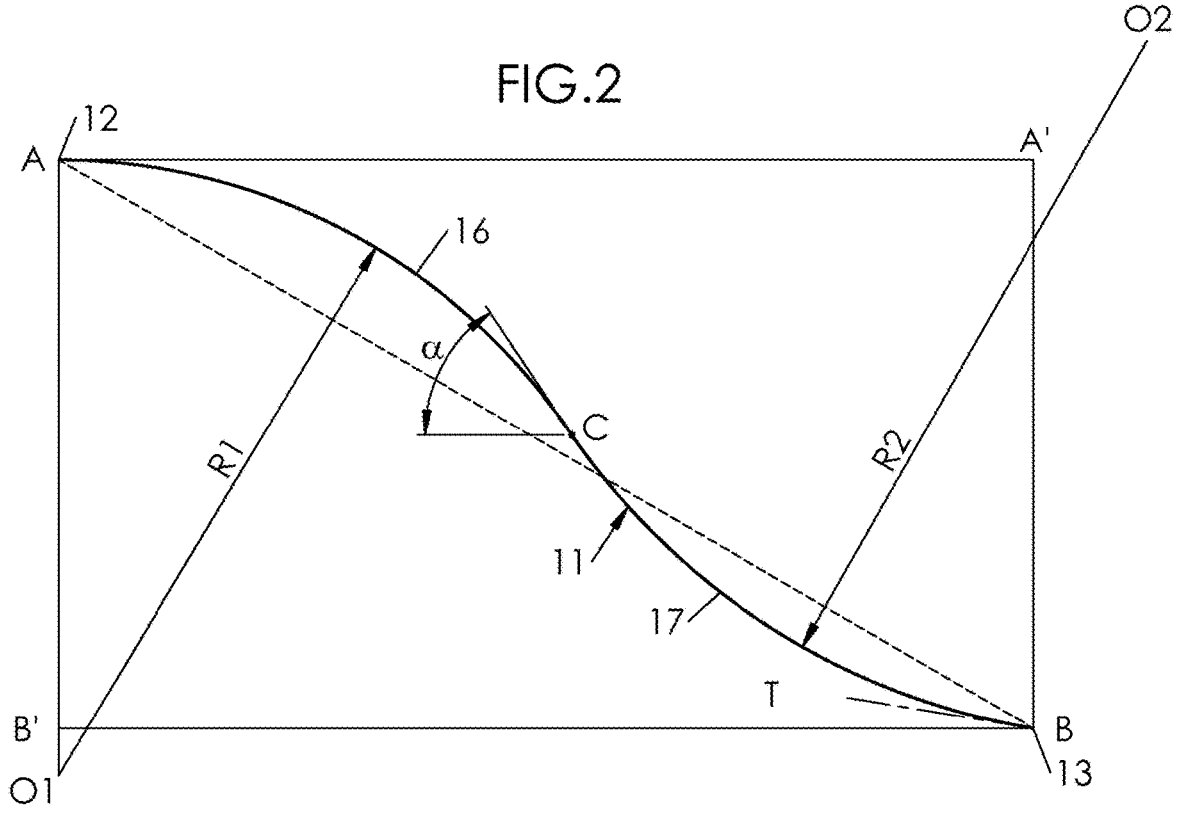
FIG. 2 is a diagrammatic view showing a proper method of construction of the base.

FIG. 2 illustrates a proper geometrical method of construction of the diaphragm 11 in a radial sectional plane. By comparison, FIG. 3 illustrates an improper geometrical method of construction of the diaphragm 11 in a similar radial sectional plane.

Figure 3:
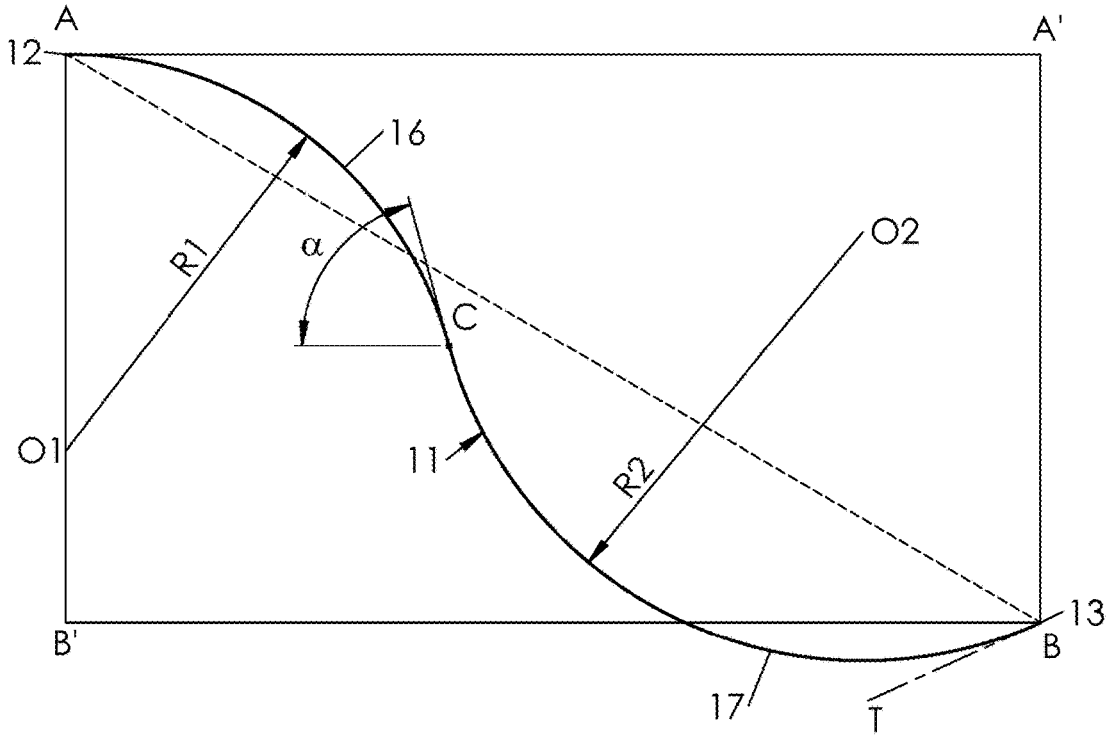
FIG. 3 is a diagrammatic view showing an improper method of construction of the base.
Figure 4:
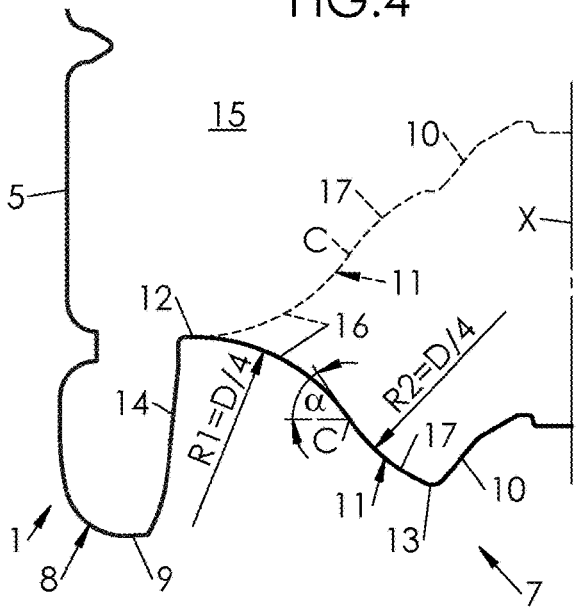
FIG. 4-FIG. 11 are enlarged half sectional views showing the base of the container in different embodiments, both in an outwardly-protruding position of the diaphragm (in continuous line) and in an inwardly-protruding position thereof (in dotted line).
Figure 5:
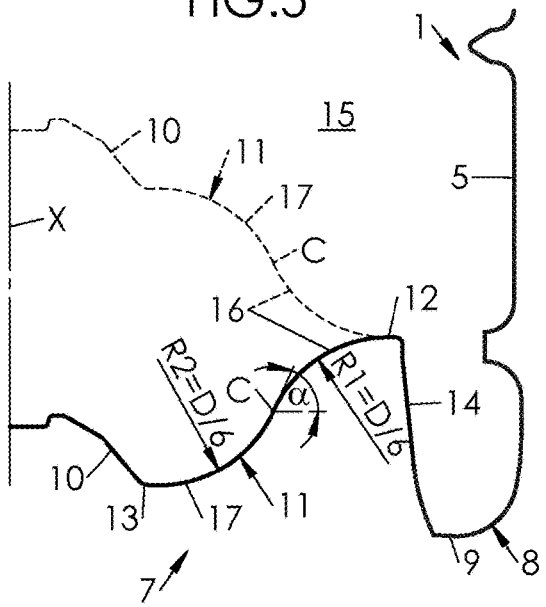
Figure 6:
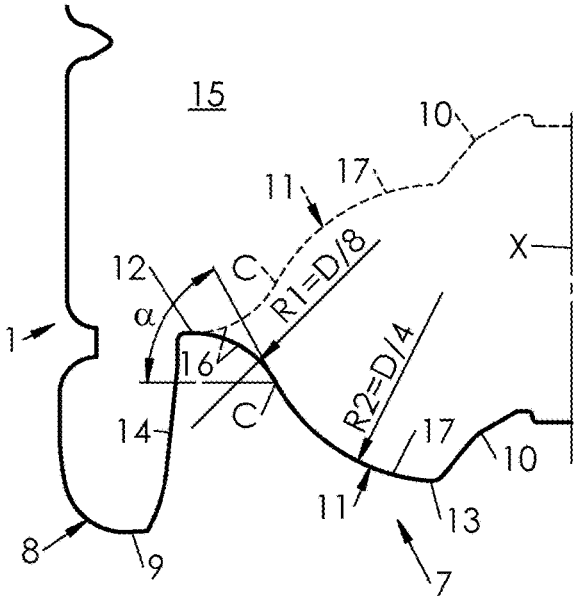
Figure 7:
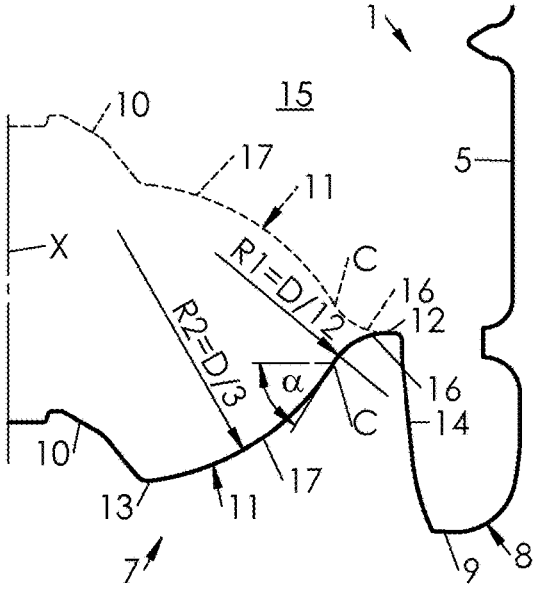
Figure 8:
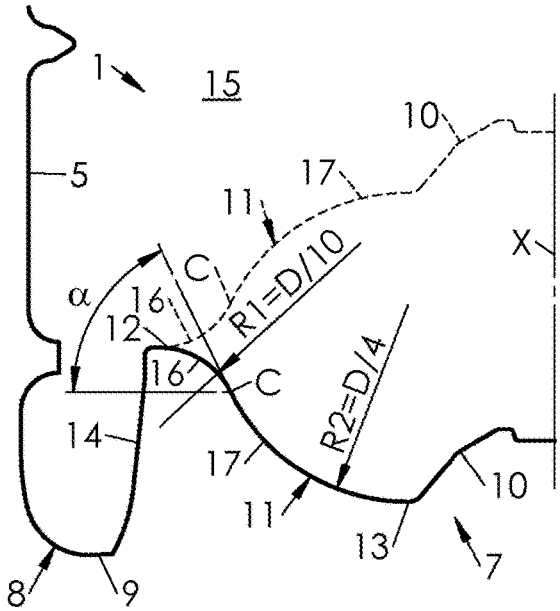
Figure 9:
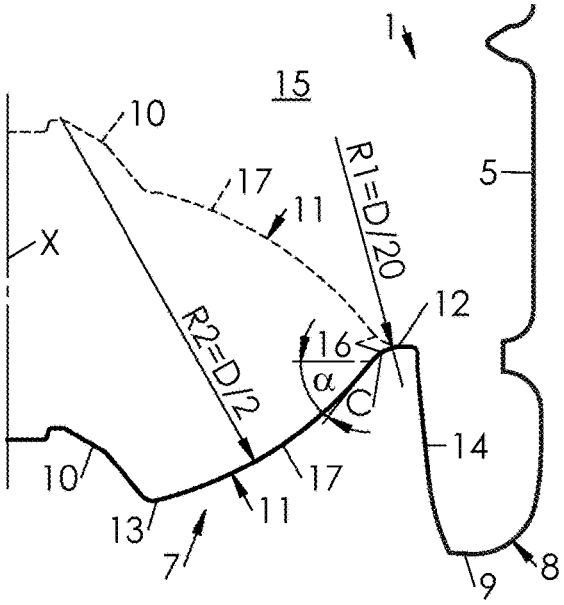
Figure 10:
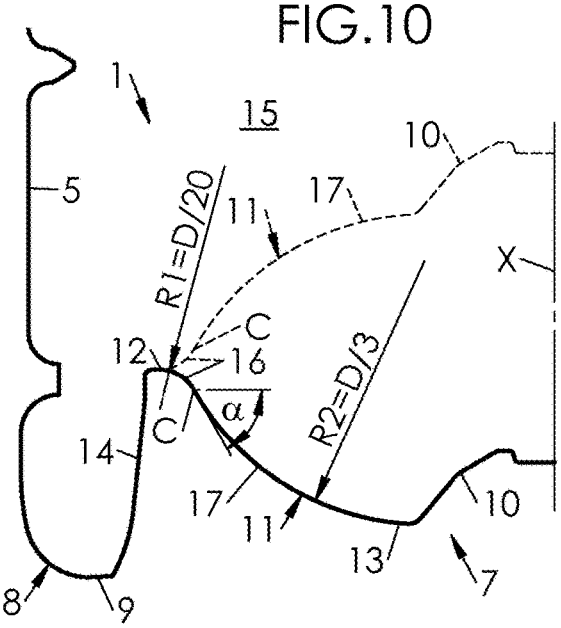
Figure 11:
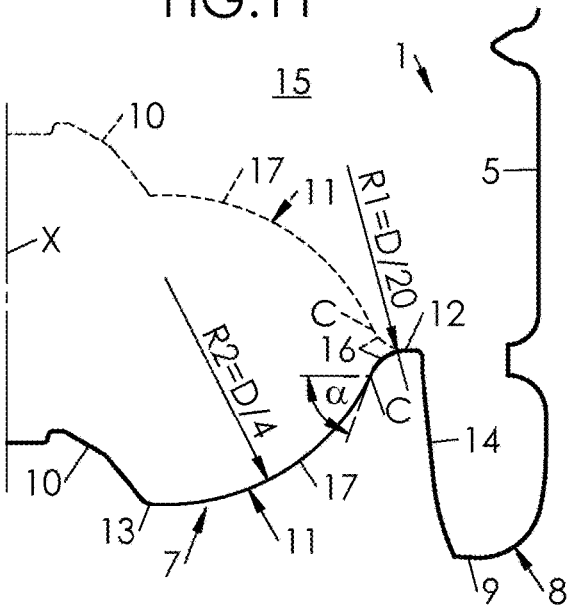

In FIG. 2 and FIG. 3, a rectangle AA'BB' is plotted where A denotes the outer junction 12 and B denotes the inner junction 13. Reference 16 denotes the outer portion of the diaphragm 11, which takes the form or arc of a circle and 17 denotes the inner portion of the diaphragm 11, also in the form of an arc of a circle. Outer portion 16 and inner portion 17 meet at a junction point denoted C, which forms an inflexion point (i.e. a point where curvature of the diaphragm 11 is inverted) between outer portion 16 and inner portion 17. As depicted on FIG. 2 and FIG. 3, the outer portion 16 is tangent to horizontal line (AA') at point A. In other words, the center of the arc of a circle AC (i.e. of outer portion 16) is located on line (AB').

Once plotted C and O1, only one arc of a circle (of center denoted O2) can be plotted joining A to C and tangent to (AA'). Then, only one arc of a circle (i.e. inner portion 17) can be plotted joining C to B and tangent to arc of a circle AC (i.e. outer portion 16) at C.

Half line [BT) denotes the tangent to arc of a circle BC with center O2. FIG. 2 illustrates the fact that, when C is located in triangle AA'B, i.e. above diagonal (AB), then the tangent [BT) is located above line (BB'). In other words, the arc of a circle BC (i.e. inner portion 17) is located above the inner junction 13, whereas, on the contrary, FIG. 3 illustrates the fact that, when C is located in triangle ABB', i.e. below diagonal (AB), then the tangent [BT) is located below line (BB'). In other words, the arc of a circle BC (i.e. inner portion 17) is located below the inner junction 13. The geometry of FIG. 2 should be preferred to build the diaphragm 11 with respect to FIG. 3.

As depicted on FIG. 4 to FIG. 11, the diaphragm 11 has, in its inwardly-protruding position (in dotted lines), a shape that is symmetrical to the shape it has in its outwardly protruding position. In other words, in the upwardly-protruding position, the outer portion 16 has a concavity turned inwards with respect to the inner volume 15 of the container 1, whereas the inner portion 17 has a concavity turned outwards with respect to the inner volume 15 of the container 1. Therefore, choosing the geometry of FIG. 3 wherein the inner portion 17 goes below the inner junction 13 would lead, in the inwardly-protruding position, to a geometry where the inverted inner portion 17 goes above the inverted inner junction 13, whereby the pressure exerted by the content in the vicinity of inner junction 13 has an outwardly-oriented radial component which might unroll the diaphragm 11 back to its outwardly-protruding position.

By contrast, choosing the geometry of FIG. 2, wherein the inner portion 17 extends above the inner junction 13 leads, in the inwardly-protruding position, to a geometry where the inverted inner portion 17 stands below the inverted inner junction 13, whereby the pressure exerted by the content in the vicinity of the inner junction 13 has only an inwardly-oriented radial component which provides a locking effect on the diaphragm 11. The geometry of FIG. 2 is therefore preferred to the geometry of FIG. 3.

One can mathematically prove that, as long as the outer portion 16 is tangent to a horizontal line (or plane)—i.e., the arc of a circle AC is tangent to line (AA'), then:

- if point C (i.e. the junction between outer portion 16 and inner portion 17) is located within the triangle AA'B, then the inner portion 17 is located above the inner junction 13 (or point B), as depicted on FIG. 2;
- if point C (i.e. junction between outer portion 16 and inner portion 17) is located on line (AB), then the inner portion 17 is tangent to the horizontal at point B, i.e. to horizontal line (BB');
- if point C (i.e. junction between outer portion 16 and inner portion 17) is located within the triangle ABB', then the inner portion 17 partly extends below the inner junction 13 (or point B), as depicted on FIG. 3.

Therefore, in a preferred embodiment, the junction C between outer portion 16 and inner portion 17 is located on or above a line (i.e. line (AB)) joining the outer junction 12 and the inner junction 13.

As depicted on FIGS. 1 and 2, d' denotes the diameter of the circle centered on axis X and including the junction point C, and a denotes the angle of the tangent to the outer portion 16 (or to inner portion 17) at their junction point C.

The extraction volume EV globally increases with diameter d' (although other parameters should be taken into account, as will be explained hereinafter). Therefore, d' should be great enough to maximize the extraction volume EV. More precisely, d' is preferably greater than half diameter D, and lower than 95% of diameter D:

$$0.5 \cdot D \leq d' \leq 0.75 \cdot D$$

The greater angle $\alpha$ is, the stiffer the diaphragm 11 is in the inwardly-protruding position but the harder it is to invert it from the outwardly-protruding position to the inwardly protruding position.

On the contrary, the lower angle $\alpha$ is, the weaker the diaphragm 11 is in the inwardly-protruding position but the easier it is to invert it from the outwardly-protruding position to the inwardly protruding position.

A good compromise may be found, between good stiffness of the diaphragm 11 in the inwardly protruding position when submitted to the pressure of the container content and good capability of the diaphragm 11 to be inverted from the outwardly-protruding position to the inwardly protruding position, when angle $\alpha$ is comprised between about 55° (which corresponds to the case where point C is located on the line (AB) joining the outer junction 12 and the inner junction 13) and 75°:

$$60° \leq \alpha \leq 75°$$

In addition, radius R1 of the outer portion 16 and radius R2 of the inner portion 17 should be chosen with care to maximize the extraction volume EV (i.e. to maximize pressure in the container in the inwardly-protruding position of the diaphragm 11) while providing good inversion capability of the diaphragm 11 and good stiffness thereof in its inwardly-protruding position.

To this end, radiuses R1 and R2 should be selected as follows:

$$\frac{D}{20} \leq R1 \leq \frac{D}{4}$$

$$\frac{D}{6} \leq R2 \leq \frac{D}{2}$$

$$R1 \leq R2$$

Inner diameter d and outer diameter D of the diaphragm 11 are preferably such that:

$$0.3 \cdot D \leq d \leq 0.5 \cdot D$$

In one preferred embodiment:

$$d \cong 0.4 \cdot D$$

FIG. 4 to FIG. 11 show various embodiments of the base 7, with respective different geometries of the diaphragm 11, sorted by increasing extraction volume, as shown in the table below, for a container of 0.5 l (other values may apply for container of greater—or smaller—volume). For all those embodiments, D is set equal to 52 mm and d to 19 mm.

| FIG. | R1 (mm) | R2 (mm) | α | d' (mm) | EV ($mm^3$) |
|---|---|---|---|---|---|
| 4 | 13 (D/4) | 13 (D/4) | 55.6° | 30.4 (0.6 · D) | 17 |
| 5 | 8.67 (D/6) | 8.67 (D/6) | 65.7° | 36 (0.7 · D) | 21.2 |
| 6 | 6.5 (D/8) | 13 (D/4) | 61.5° | 40.4 (0.78 · D) | 22.7 |
| 7 | 4.3 (D/12) | 17.3 (D/3) | 58.4° | 44.4 (0.85 · D) | 24.1 |
| 8 | 5.2 (D/10) | 13 (D/4) | 63.8° | 42.5 (0.82 · D) | 24.2 |
| 9 | 2.6 (D/20) | 26 (D/2) | 51.8° | 47.7 (0.92 · D) | 24.3 |
| 10 | 2.6 (D/20) | 17.3 (D/3) | 60.8° | 47.2 (0.91 · D) | 26.2 |
| 11 | 2.6 (D/20) | 13 (D/4) | 70° | 46.9 (0.9 · D) | 28.4 |

All those embodiments provide greater extraction volume EV than the known solutions, while diaphragm 11 is more or equally rigid in the inwardly-protruding position. While the outer portion 16 serves to facilitate inversion of the diaphragm 11 from the outwardly-protruding position to the inwardly-protruding position, inner portion 17 serves to strengthen the diaphragm 11 in the inwardly-protruding position and prevents it from sinking back to its outwardly-protruding position. Pressure within the container 1 can therefore be maintained at a high value. The container 1 feels rigid when held in hand. In addition, the container 1 provides, when stacked, stability to the pile and, when palletized, stability to the pallet.

As illustrated on the drawings, the diaphragm 11 has a smooth surface (i.e. it is free of ribs or grooves), as the geometry and dimensions described hereinbefore suffice to provide inversion capability and mechanical strength.

The invention claimed is:

1. Container (1) made of a plastic material, provided with a base (7) including a standing ring (8) forming a support flange (9) and, a diaphragm (11) extending from the standing ring (8) to a central portion (10), said diaphragm (11) being capable of standing in an outwardly-protruding position, said container (1) defining an inner volume to be filled with a product, wherein the diaphragm (11) connects to the standing ring (8) at an outer junction (12) forming an outer articulation of the diaphragm (11) with respect to the standing ring (8);

wherein the diaphragm (11) connects to the central portion (10) at an inner function (13) forming an inner articulation of the diaphragm (11) with respect to the central portion (10);

whereby said diaphragm (11) is invertible with respect to the standing ring (8) from the outwardly-protruding position, in which the inner junction (13) extends below the outer junction (12), to an inwardly-protruding position in which the inner junction (13) extends above the outer junction (12);

wherein, in the outwardly-protruding position of the diaphragm (11), the central portion (10) stands above the standing ring (8) and the diaphragm (11) has:

an outer portion (16) which connects to the standing ring (8) and is curved in radial section, said outer portion having a concavity turned outwards with respect to the inner volume of the container (1), and an inner portion (17) which connects to the outer portion (16) and to the central portion (10) and is curved in radial section, said inner portion having a concavity turned inwards with respect to the inner volume of the container (1).

2. Container according to claim 1, wherein the inner portion (17) is tangent to the outer portion (16).

3. Container according to claim 1, wherein the radius, denoted R1, of the outer portion (16) and the outer diameter, denoted D, of the diaphragm at the outer junction (12) a such that:

$$\frac{D}{20} \leq R1 \leq \frac{D}{4}.$$

4. Container according to claim 1, wherein the radius, denoted R2, of the inner portion (17) and outer diameter, denoted D, of the diaphragm at the outer junction (12) are such that:

$$\frac{D}{6} \leq R2 \leq \frac{D}{2}.$$

5. Container according to claim 1, wherein the radius, denoted R1, f the outer portion (16) and the radius, denoted R2, of the inner portion (17), are such that:

$R1 \leq R2$.

6. Container according to claim 1, wherein the outer diameter, denoted D, of the diaphragm at the outer junction (12), and its inner diameter, denoted d at the inner junction (13), are such that:

$0.3 \cdot D \leq d \leq 0.6 \cdot D$.

7. Container according to claim 6, wherein:

$d \cong 0.4 \cdot D$.

8. Container according to claim 1, wherein the diaphragm (11) has a smooth surface.

9. Container according to claim 1, wherein a junction point (C) between the outer portion (16) and the inner portion (17) is located above or on a line joining the outer junction (12) and the Inner junction (13).

10. Container according to claim 2, wherein the radius, denoted R1, of the outer portion (16) and the outer diameter, denoted D, of the diaphragm at the outer junction (12) are such that:

$$\frac{D}{20} \leq R1 \leq \frac{D}{4}.$$

11. Container according to claim 2, wherein the radius, denoted R2, of the inner portion (17) and the outer diameter, denoted D, of the diaphragm at the outer junction (12) are such that:

$$\frac{D}{6} \leq R2 \leq \frac{D}{2}.$$

12. Container according to claim 3, wherein the radius, denoted R2, of the inner portion (17) and the outer diameter, denoted D, of the diaphragm at the outer junction (12) are such that:

$$\frac{D}{6} \leq R2 \leq \frac{D}{2}.$$

13. Container according to claim 2, wherein the radius, denoted R1, of the outer portion (16) and the radius, denoted R2, of the inner portion (17), are such that:

$R1 \leq R2$.

14. Container according to claim 3, wherein the radius, denoted R1, of the outer portion (16) and the radios, denoted R2, of the inner portion (17), are such that:

$R1 \leq R2$.

15. Container according to claim 4, wherein the radius, denoted R1, of the outer portion (16) and the radius, denoted R2, of the inner portion (17), are such that:

$R1 \leq R2$.

16. Container according to claim 2, wherein the outer diameter, denoted D, of the diaphragm at the outer junction (12), and its inner diameter, denoted d, at the inner junction (1), are such that:

$0.3 \cdot D \leq d \leq 0.6 \cdot D$.

17. Container according to claim 3, wherein the outer diameter, denoted D, of the diaphragm at the outer junction (12), and its inner diameter, denoted d, at the inner junction (13), are such that:

$0.3 \cdot D \leq d \leq 0.6 \cdot D$.

18. Container according to claim 4, wherein the outer diameter, denoted D, of the diaphragm at the outer junction (12), and its inner diameter, denoted d, at the inner junction (13), are such that:

$0.3 \cdot D \leq d \leq 0.6 \cdot D$.

19. Container according to claim 5, wherein the outer diameter, denoted D, of the diaphragm at the outer junction (12), and its inner diameter, denoted d, at the inner junction (13), are such that:

$0.3 \cdot D \leq d \leq 0.6 \cdot D$.

20. Container according to claim 2, wherein the diaphragm (11) has a smooth surface.

* * * * *